US007870908B2

(12) United States Patent
Mandrou

(10) Patent No.: US 7,870,908 B2
(45) Date of Patent: Jan. 18, 2011

(54) DOWNHOLE VALVE HAVING INCREMENTALLY ADJUSTABLE OPEN POSITIONS AND A QUICK CLOSE FEATURE

(75) Inventor: Laure Mandrou, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/842,273

(22) Filed: Aug. 21, 2007

(65) Prior Publication Data

US 2009/0050335 A1 Feb. 26, 2009

(51) Int. Cl.
*E21B 34/00* (2006.01)
*E21B 34/10* (2006.01)

(52) U.S. Cl. ..... 166/386; 166/321; 166/331; 166/375

(58) Field of Classification Search ..... 166/321, 166/331, 320, 375, 386; 251/253
See application file for complete search history.

(56) References Cited

U.S. PATENT DOCUMENTS 3,955,623 A 5/1976 Aumann
4,355,685 A * 10/1982 Beck ..... 166/240
5,901,796 A * 5/1999 McDonald ..... 175/57
6,668,935 B1 * 12/2003 McLoughlin et al. ..... 166/375
6,782,952 B2 8/2004 Garay
6,948,561 B2 * 9/2005 Myron ..... 166/240
7,013,980 B2 3/2006 Purkis
7,108,068 B2 9/2006 Stevens
7,237,472 B2 7/2007 Cove
2005/0263279 A1 * 12/2005 Vachon ..... 166/250.01
2007/0163774 A1 7/2007 Hosatte
2007/0251697 A1 * 11/2007 Loretz et al. ..... 166/374

FOREIGN PATENT DOCUMENTS

GB 2434166 A 7/2007

* cited by examiner

*Primary Examiner*—Kenneth Thompson
*Assistant Examiner*—Cathleen R Hutchins

(57) ABSTRACT

A valve that is usable with a well includes an indexer and a closing mechanism. The indexer includes a profile to establish a sequence of open settings for the valve, and the indexer is adapted to respond to first control stimuli to transition the valve through the settings according to the sequence. The closing mechanism is adapted to operate independently of the sequence in response to a second control stimulus to close the valve.

21 Claims, 3 Drawing Sheets

DOWNHOLE VALVE HAVING INCREMENTALLY ADJUSTABLE OPEN POSITIONS AND A QUICK CLOSE FEATURE

BACKGROUND

The invention generally relates to a downhole valve that has incrementally adjustable open positions and a quick close feature.

In well testing and production, it is often desirable to regulate the flow of well fluid into a tubing string. For this purpose, the tubing string may include a valve. As a more specific example, a particular type of valve is a multiple position valve, or choke. In general, the choke may have a closed setting that blocks well fluid communication through the valve, and the choke may also have multiple discrete open settings. Each open setting establishes a different cross-sectional flow area for the choke, and thus, the choke may have multiple incrementally adjustable open positions.

A conventional choke may contain a J-slot mechanism to transition the choke through its settings. With a J-slot mechanism, the choke cannot be randomly changed between settings; but rather, the choke's open and closed settings follow a predefined order, or sequence, which is established by the corresponding J-slot groove. Each setting change may be effected, for example, by cycling the pressure in a control line.

The sequence that is imposed by the J-slot mechanism may limit how quickly the choke can be closed. For example, the choke may currently be at open setting number two, out of eight open settings (as an example). To transition the choke to the closed setting from open setting number two, the choke may need to transition through all of the intervening settings (i.e., open setting number three through open setting number eight) before the closed setting is reached.

SUMMARY

In an embodiment of the invention, a valve that is usable with a well includes an indexer and a closing mechanism. The indexer includes a profile to establish a sequence of open settings for the valve, and the indexer is adapted to respond to first control stimuli to transition the valve through the settings according to the sequence. The closing mechanism is adapted to operate independently of the sequence in response to a second control stimulus to close the valve.

In another embodiment of the invention, a system that is usable with a well includes a string, a first control line and a second control line. The string includes a valve to control fluid communication between the well and a central passageway of the string. The valve includes an indexer and a closing mechanism. The indexer includes a profile to establish a sequence of open settings for the valve, and the indexer is adapted to respond to first signals to transition the valve through the settings according to the sequence. The closing mechanism is adapted to operate independently of the sequence in response to a second signal to close the valve.

In yet another embodiment of the invention, a technique that is usable with a well includes providing a profile to establish a sequence of open settings for a valve. The technique includes transitioning the valve through the open settings in response to first stimuli; and in response to a second stimulus, closing the valve. The closing of the valve is independent of the sequence.

Advantages and other features of the invention will become apparent from the following drawing, description and claims.

DETAILED DESCRIPTION

Figure 1:
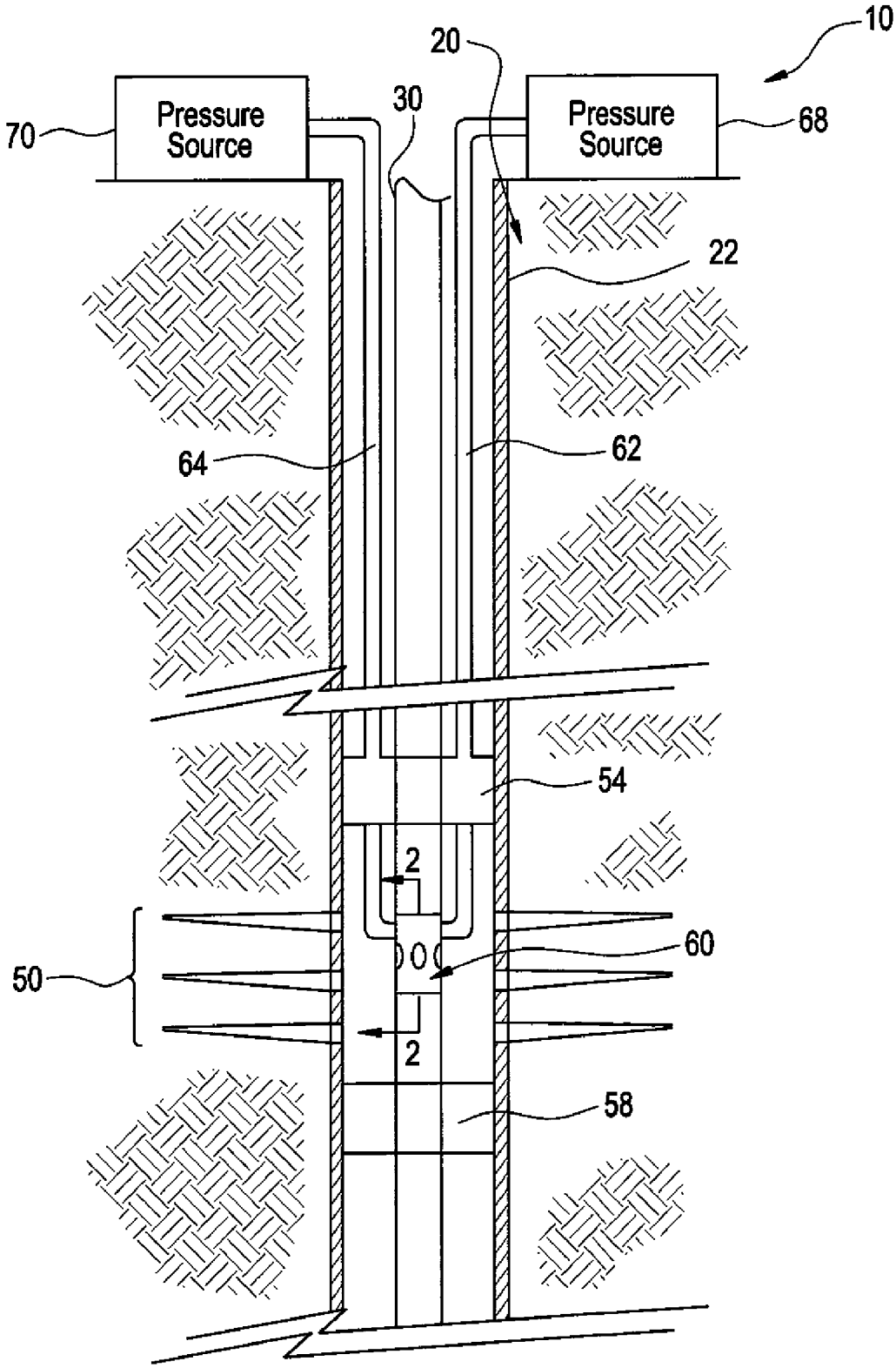
FIG. 1 is a schematic diagram of a well according to an embodiment of the invention.

Referring to FIG. 1, an embodiment 10 of a well in accordance with the invention includes a wellbore 20 that is lined with a casing string 22, although the wellbore 20 may be cased or uncased, depending on the particular embodiment of the invention. A tubular string 30 extends into the wellbore 20, and as depicted in FIG. 1, the string 30 extends through a particular production zone 50, which may be isolated by upper 54 and lower 58 packers, for example.

It is noted that although FIG. 1 depicts the wellbore 20 as being a vertical wellbore, the string 30 may likewise extend through a lateral, or deviated wellbore, in accordance with other embodiments of the invention. Additionally, the well 10 may be a subterranean or a subsea well, depending on the particular embodiment of the invention. Thus, many variations are contemplated and are within the scope of the appended claims.

The string 30 includes a flow control device, or valve, such as a downhole multi-position choke 60. As described herein, the choke 60 has a closed setting to block all well fluid through the choke and multiple discrete open settings. Each open setting establishes a different cross-sectional area through the choke's well fluid flow path. For example, one of the open settings may establish a twenty-five percent cross-sectional area; another open setting may establish a seventy-five percent cross-sectional area; and another open setting may fully open well fluid communication through the choke 60.

In accordance with embodiments of the invention described herein, the open settings of the choke 60 cannot be randomly selected, but rather, the setting selection is subject to a predefined selection order, or sequence. As a more specific example, in accordance with some embodiments of the invention, the choke 60 transitions from one open setting to the next in response to control stimuli, such as pressure signals, which are communicated through an open choke control line 64. The control line 64 may, for example, extend between the choke 60 and a surface pressure source 70 (as an example).

As a specific example, an exemplary pressure signal to transition the choke 60 from one open setting to the next may involve pressurizing the control line 64 (via the pressure source 70) above a pressure threshold and thereafter bleeding the control line pressure below the pressure threshold. For example, if the choke 60 is currently at the fifty percent open setting (as a non-limiting example), then the application of the next pressure signal may cause the choke 60 to transition to the sixty-seven percent open setting (as a non-limiting example). It is noted that other types of pressure signals other than a simple pressure up and down cycle may be used to cycle the choke 60 through its open settings, in accordance with other embodiments of the invention.

For purposes of closing the choke 60, a control stimulus, such as a pressure signal (a pressure that exceeds a predefined threshold, for example), may be applied via a close control line 62, a control line that may extend between the choke 60 and a surface pressure source 68 (as an example). The ability of the choke 60 to transition to the closed setting is independent of the above-described selection sequence for the open settings and thus, does not depend on the current setting of the choke 60. Therefore, in response to a single pressure cycle in the control line 62, the choke 60 is capable of bypassing any part of the selection sequence to immediately transition from any one of the open settings to the closed setting. In accordance with some embodiments of the invention, a single pressurization of the control line 62 causes the choke 60 to rapidly close, regardless of the current setting of the choke 60.

As a more specific example, the control lines 62 and 64 may be pressurized in the following manner for purposes of controlling the choke 60 in accordance with some embodiments of the invention. In general, to select a particular open setting, the pressure in the control line 62 may be maintained below a minimum threshold; and the pressure in the control line 64 may then be manipulated to cycle the choke 60 until the desired setting is reached. More specifically, in accordance with some embodiments of the invention, each time the pressure in the control line 64 is pressurized above a certain threshold, the choke 60 advances pursuant to the selection sequence from one open setting to the next. After each setting change, the control line 64 may be bled off, or de-pressurized, below the minimum pressure threshold and subsequently re-pressurized to advance the choke 60 to the next setting. As set forth above, at any time, the control line 64 may be de-pressurized and the control line 62 may be pressurized for purposes of closing the choke 60.

Figure 2:
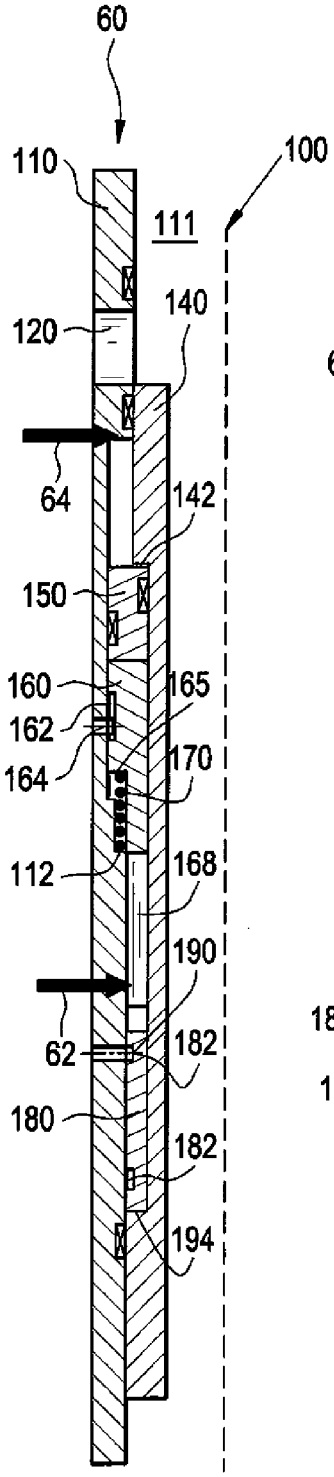
FIGS. 2 and 3 are partial cross-sectional views of the choke of FIG. 1 for different operational states of the choke taken along line 2-2 of FIG. 1 according to an embodiment of the invention.

FIG. 2 depicts a partial cross-sectional view of the choke 60, taken along line 2-2 of FIG. 1. In particular, FIG. 2 depicts the left-hand view of the cross-sectional diagram on the left-hand side of a longitudinal axis 100. The longitudinal axis 100, in general, is coaxial with the longitudinal axis of the string 30 near the choke 60. As can be appreciated by one of skill in the art, the choke 60 is generally symmetrical about the longitudinal axis 100, with the right-hand cross-section being omitted from FIG. 2.

In general, the choke 60 includes a housing 110 that includes radial ports 120 (one radial port 120 being depicted in FIG. 2) that are formed in the housing 110. Although the housing 110 is depicted in the figures as being an outer housing, it is noted that in other embodiments of the invention, the housing 110 may be an inner housing. Fluid communication between the radial ports 120 and a central passageway 111 (which is in fluid communication with a central passageway of the string 30) of the choke 60 is controlled by the axial position of a sleeve 140, which may be an inner (as depicted in the figures) or outer sleeve, depending on the particular embodiment of the invention.

For the state of the choke depicted in FIG. 2, the choke 60 is fully open, i.e., the choke 60 is in the open setting at which full fluid communication occurs through the ports 120. For the other open settings of the choke 60, the sleeve 140 moves upwardly to partially close fluid communication through the ports 120, and the extent of the upward travel of the sleeve 40 is a function of the particular open setting.

The sequencing of the choke 60 is controlled by the action of an indexer, which, as an example, may include an incrementer, such as an exemplary incrementing sleeve 160, and an indexing sleeve 180. The incrementing 160 and indexing 180 sleeves generally circumscribe the longitudinal axis 100. In general, the indexing sleeve 180 includes an outer cam groove 182 that spirally, or helically, extends around the longitudinal axis 100 and is engaged by a pin 190 that is attached to and radially extends from the interior of the housing 110.

The incrementing sleeve 160, as described below, responds to pressure signals in the control line 64 (via a floating piston 150 described below) to move axially, rotate and engage the indexing sleeve 180. The engagement of the indexing sleeve 180 by the incrementing sleeve 160 causes the indexing sleeve 180 to axially change positions and rotate. The axial translation of the indexing sleeve 180, in turn, causes a corresponding axial position translation of the sleeve 140 to change the position of the sleeve 140 with respect to the radial ports 120. Therefore, from the fully open setting of the choke 60 that is depicted in FIG. 2, each cycle of the incrementing sleeve 160 (as described below) causes a corresponding translation and rotation of the indexing sleeve 180 to incrementally advance the sleeve 140 upwardly to a different position and thus, establish a different open setting for the choke 60.

As depicted in FIG. 2, the choke 60 includes a spring 170 (a coiled spring, for example) that resides between an inner annular shoulder 112 of the housing 110 and an outer annular shoulder 165 of the incrementing sleeve 160 for purposes of returning the incrementing sleeve 160 to an initial position after the incrementing sleeve 160 incrementally adjusts the position of the indexing sleeve 180, as described below. The floating piston 150 resides in an annular cavity that is formed between the incrementing sleeve 160 and a lower shoulder 142 of the sleeve 140. The piston 150 isolates the control lines 62 and 64. As depicted in FIG. 2, the control line 62 extends through a radial port of the housing 110 to establish fluid communication between the control line 62 and the region below the piston 150; and the control line 64, via a radial port in the housing 110, establishes fluid communication above the piston 150.

Figure 4:
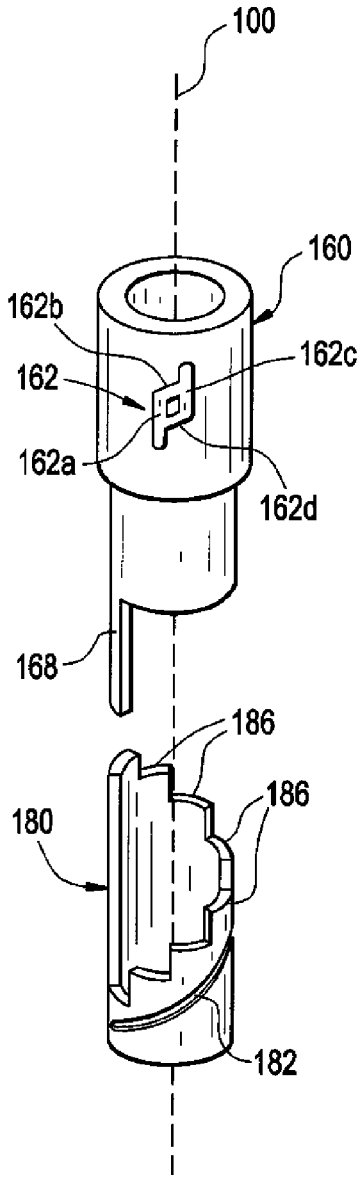
FIG. 4 is an exploded perspective view of incrementing and indexing sleeves of the choke according to an embodiment of the invention.

Referring to FIG. 4 in conjunction with FIG. 2, the choke 60 may be operated in the following manner. It is assumed for this discussion that the close control line 62 is de-pressurized (i.e., the control line 64 has a pressure below a minimum pressure threshold). When pressure is applied to the control line 64, the floating piston 150 moves in a downward position and moves the incrementing sleeve 160 toward the indexing sleeve 180 while compressing the spring 170. Due to this downward translation of the incrementing sleeve 160 a lower finger 168 of the incrementing sleeve 160 contacts one of a plurality of stepped faces 186 of the indexing sleeve 180. The stepped faces 186 collectively form a profile that establishes the selection sequence for the open settings of the choke 60. As depicted in FIG. 4, in accordance with some embodiments of the invention, the stepped faces 186 may be formed in the upper end of the indexing sleeve 180.

In other embodiments of the invention, the incrementing sleeve 160 may include a plurality of fingers 168. For these embodiments of the invention, the pattern of stepped faces 186 depicted in FIG. 4 is repeated on the circumference of the indexing sleeve 180, so that each finger 168 has an associated pattern of stepped faces 186.

Upon the engagement of the lower finger 168 with one of the stepped faces 186, the incrementing sleeve 160 pushes the indexing sleeve 180 downwardly, which causes the indexing sleeve 180 to engage an annular shoulder 194 of the sleeve 140, thereby resulting in incrementing the choke's position. Because the incrementing sleeve 160 and indexing sleeve 180 have cam grooves 162 and 182, respectively, both of these sleeves rotate while axially translating as soon as they engage with each other. This rotational movement is not transmitted to the sleeve 140. The translation movement stops when the incrementing sleeve 160 contacts the housing 110.

When the pressure in the open control line 64 is bled off, the spring 170 axially translates the incrementing sleeve 160 in an upward direction and the sleeve 160 engages the floating piston 150. Because displacement of the incrementing sleeve 160 is controlled by the cam groove 162 (as further described below in connection with FIGS. 5-9), the incrementing sleeve 160 rotates and translates back to its initial position and is therefore ready to engage the next stepped face 186 of the indexing sleeve 180 (which has rotated one incremental position since the last engagement).

Figure 3:
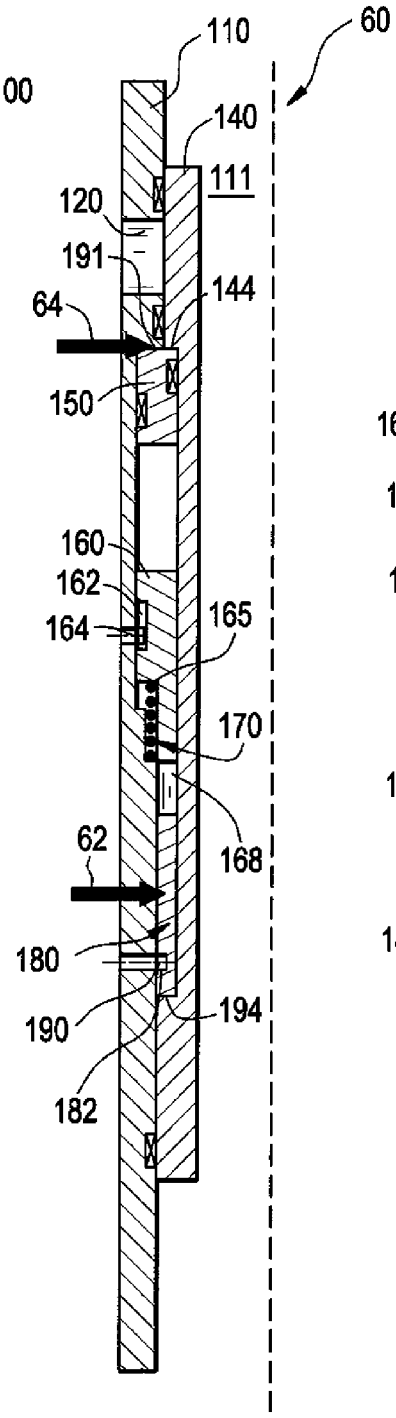

FIG. 3 depicts a partial cross-sectional view of the choke 60, illustrating the choke 60 when in its closed position. For this state of the choke 60, pressure in the control line 64 is bled off, and the closed control line 62 is pressurized. The floating piston 150 and the sleeve 140 form at least part of a closing mechanism of the choke 60, in accordance with some embodiments of the invention. More specifically, when pressure is applied to the control line 62 (regardless of the current setting of the choke 60), the floating piston 150 moves upwardly and engages the sleeve 140, thereby pushing the sleeve 140 in an upward direction until the floating piston 150 lodges against an interior annular shoulder 191 of the housing 110. During this movement, the sleeve 140 engages the incrementing sleeve 180, which rotates in return due to the cam profile 182 (see FIG. 4). Once the sleeve 140 reaches this fully closed position, the indexing sleeve 180 has fully rotated so that it is ready to increment to open setting number one when pressure is once again applied to the open control line 64. The structure of the closing mechanism may be varied in other embodiments of the invention.

Referring back to FIG. 4, the cam groove 162 of the increment sleeve 160 has a profile that permits the increment sleeve 160 to rotate after each engagement with the indexing sleeve 180 and then return to its initial position (ready to increment to open setting number one) after engagement with the sleeve 140. FIGS. 5, 6, 7, 8 and 9 illustrate the interaction between the increment 160 and indexing 180 sleeves and the role of the cam groove 162, in accordance with some embodiments of the invention.

Figure 5:
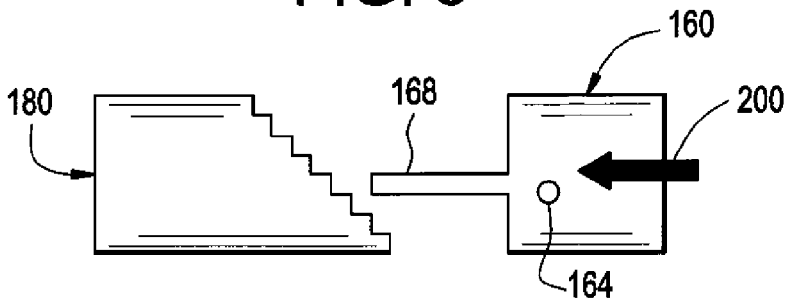
FIGS. 5, 6, 7, 8 and 9 are illustrations depicting interaction between the incrementing and indexing sleeves according to an embodiment of the invention.
Figure 6:
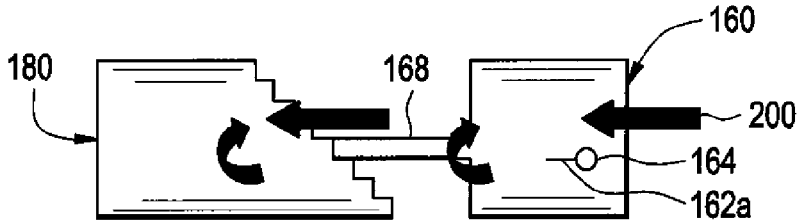

FIG. 5 depicts the state of the incrementing sleeve 160 and indexing sleeve 180 sleeves when pressure is applied to the open control line 64 (the close control line 62 is assumed to be de-pressurized). This pressure produces an axial force 200 via the floating piston 150 that pushes the incrementing sleeve 160 towards the indexing sleeve 180, until the indexing sleeve 180 is engaged by the lower finger 168 of the incrementing sleeve 160. Referring to FIG. 6, the finger 168 comes into contact with one of the stepped faces of the indexing sleeve 180. During this translation of the incrementing sleeve 160 towards the indexing sleeve 180, the pin 164 (see FIG. 3, for example) traverses the portion 162*a* of the cam groove 162.

Referring to FIG. 6, after the indexing sleeve 160 and the incrementing sleeve 180 are in contact, they both rotate and axially translate at the same time due to the cam profile 162 of the indexing sleeve 160 and the cam profile 182 of the incrementing sleeve 180. This interaction transitions the choke 60 to the next open setting. During this translation and rotation of the indexing sleeve 160 with the incrementing sleeve 180, the pin 164 (see FIG. 3, for example) traverses the portion 162*b* of the cam groove 162.

Figure 7:
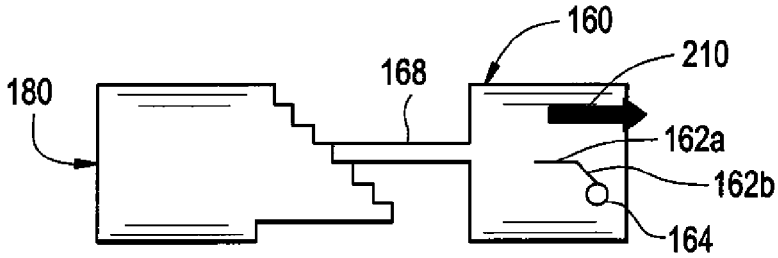

Referring to FIG. 7, upon bleeding of the pressure from the open control line 64, an axial force 210 is produced by the spring 170 (see FIG. 3, for example) to push the incrementing sleeve 160 and floating piston 150 (see FIG. 2, for example) back to their initial positions. Before the axial force 210 is produced the pin 164 is at the intersection of the portion 162*b* and 162*c*. It has already traversed 162*b* and is ready to move into 162*c* as soon as the axial force 210 starts being produced.

Figure 8:
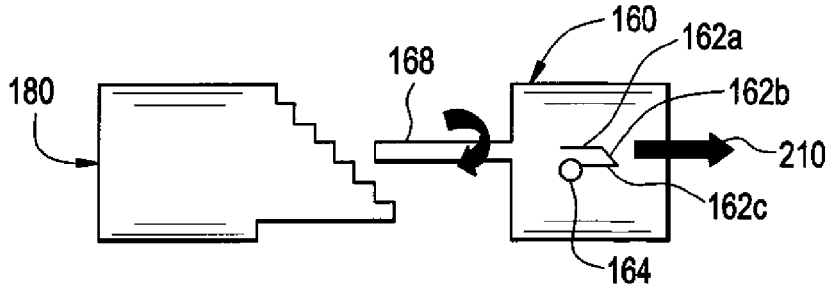
Figure 9:
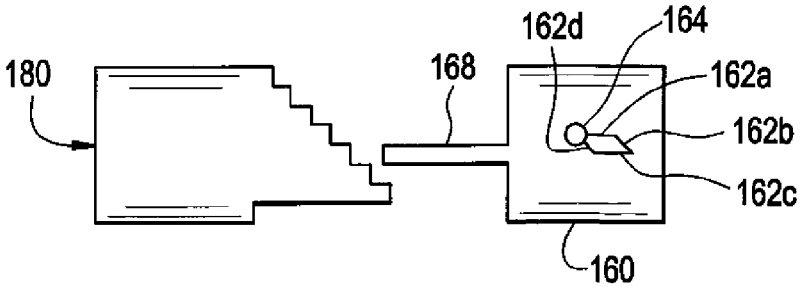

Referring to FIG. 8, the pin 164 has finished traversing the portion 162*c* of the cam groove 162, and is ready to cause the incrementing sleeve 160 to rotate and translate on the last portion of the return stroke. Referring to FIG. 9, the pin 164 then traverses the portion 162*d* of the cam groove 162 to place the incrementing sleeve 160 ready to engage to the next position on the next pressurization of the control line 64.

Other embodiments are within the scope of the appended claims. For example, in accordance with other embodiments of the invention, control stimuli other than pressure signals (such as electrical signals, for example) may be used to select the choke's settings, regardless of whether the setting is one of the multiple open settings or the closed setting. For these embodiments of the invention, the choke may include an electro-mechanical actuator, for example. As another example, in other embodiments of the invention, at least part of the choke's operation may be controlled using stimuli that are applied using a downhole tool (a shifting tool, for example). As other examples, the stimuli used to control the choke may be wireless, hard-wired, etc. Thus, the choke may contain a variety of different control mechanism to responds to the many different types of stimuli, and all of these variations are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A valve usable with a well, comprising:

an indexer comprising a profile and a member to which the profile serves as a guide to establish a sequence of open settings for the valve in response to relative movement of the member along a path defined by the profile, wherein the sequence of open settings includes at least one intermediate setting between an open and a closed position of the valve and the indexer being adapted to transition the valve through the settings according to the sequence in response to first control stimuli; and a closing mechanism adapted to operate independently of where the member is located on the path in response to a second control stimulus to close the valve, wherein the first control stimuli are communicated to the valve via a first control line and the second control stimulus is communicated to the valve via a second control line.

2. The valve of claim 1, wherein the indexer comprises:

an indexing sleeve comprising the profile; and an incrementer to translate and engage the indexing sleeve in response to each of the first control stimuli.

3. The valve of claim 2, wherein the indexing sleeve is adapted to rotate in response to being engaged by the incrementer.

4. The valve of claim 2, wherein the indexing sleeve comprises a groove to engage a pin to cause the indexing sleeve to rotate in response to being engaged by the incrementer.

5. The valve of claim 2, wherein the incrementer is adapted to rotate the indexing sleeve in response to the incrementer engaging the indexing sleeve and the incrementer comprises a sleeve adapted to rotate with the indexing sleeve.

6. The downhole tool of claim 2, wherein the incrementer is adapted to rotate the indexing sleeve in response to the incrementer engaging the indexing sleeve and the incrementer comprises a sleeve adapted to reset to an initial rotational position after rotating the indexing sleeve.

7. The valve of claim 2, wherein the first control stimuli are communicated to the valve via pressure in the first control line, the valve further comprising:

a spring to reset the incrementer in response to de-pressurization of the first control line.

8. The valve of claim 1, wherein the first control stimuli comprise pressure signals.

9. The valve of claim 1, wherein the indexer comprises a sleeve, and the profile comprises a stepped profile formed on one end of the sleeve.

10. The valve of claim 1, wherein the closing mechanism further comprises:

a piston adapted to isolate the first control line from the second control line and communicate a force to actuate the indexer in response to pressure in the first control line.

11. The valve of claim 1, further comprising:

a housing comprising at least one radial port; and a sleeve to control fluid communication through said at least one port and being adapted to respond to the indexer to establish one of the open settings, wherein the closing mechanism comprises a piston to respond to the second control stimulus to reset an axial position of the sleeve to close off fluid communication through said at least one radial port in response to the second control stimulus.

12. A system usable with a well, comprising:

a string comprising a central passageway;

a first control line;

a second control line; and a valve being part of the string to control fluid communication between the well and the central passageway of the string, the valve comprising:

an indexer comprising a profile to establish a sequence of open settings for the valve, in which the sequence of open settings includes at least one intermediate setting between an open and a closed position of the valve, the indexer adapted to transition the valve through the settings according to the sequence in response to first pressure signals communicated through the first control line; and a closing mechanism to respond to a second pressure signal communicated through the second control line to bypass at least part of the sequence to close the valve.

13. The system of claim 12, wherein the indexer comprises:

an indexing sleeve comprising the profile; and an incrementer to translate and engage the indexing sleeve in response to each of the first signals.

14. The system of claim 13, wherein the indexing sleeve is adapted to rotate in response to being engaged by the incrementer.

15. The system of claim 13, wherein the indexing sleeve comprises a groove to engage a pin to cause the indexing sleeve to rotate in response to being engaged by the incrementer.

16. The system of claim 13, wherein the incrementer is adapted to rotate the indexing sleeve in response to the incrementer engaging the indexing sleeve and the incrementer comprises a sleeve adapted to rotate with the indexing sleeve.

17. The system of claim 13, wherein the incrementer is adapted to rotate the indexing sleeve in response to the incrementer engaging the indexing sleeve and the incrementer comprises a sleeve adapted to reset to an initial rotational position after rotating the indexing sleeve.

18. A method usable with a well, comprising:

providing an indexer comprising a profile and a member to which the profile serves as a guide to establish a sequence of open settings for a valve, wherein the sequence of open settings includes at least one intermediate setting between an open and a closed position of the valve;

transitioning the valve through the open settings in response to a first stimuli actuating the indexer through the sequence, the transitioning comprising causing relative movement of the member along a path defined by the profile;

in response to a second stimulus, closing the valve, the act of closing being independent of where the member is located on the path;

communicating the first stimuli to the valve via a first control line; and communicating the second stimulus to the valve via a second control line other than the first control line.

19. The method of claim 18, wherein the act of transitioning comprises:

engaging an indexing sleeve in response to the first stimuli.

20. The method of claim 18, wherein the act of transitioning comprises:

axially translating a sleeve that moves in a path that coincides with a fluid communication port in a housing of the valve.

21. The method of claim 18, wherein the act of closing comprises:

moving a sleeve of the valve to an axial position in which substantially no fluid communication occurs through a fluid communication port of the valve.

* * * * *